United States Patent [19]

Dillon et al.

[11] Patent Number: 4,519,107

[45] Date of Patent: May 28, 1985

[54] BOXSPRING HAVING COIL COMPRESSION STOPS

[75] Inventors: Paul J. Dillon, Atlanta; Walter Stumpf, Dunwoody, both of Ga.

[73] Assignee: Simmons U.S.A. Corporation, Atlanta, Ga.

[21] Appl. No.: 512,099

[22] Filed: Jul. 8, 1983

[51] Int. Cl.[3] ..... A47C 23/08

[52] U.S. Cl. ..... 5/261; 5/305

[58] Field of Search ..... 5/239, 253, 261, 262, 5/305; 267/91, 105, 167, 169

[56] References Cited

U.S. PATENT DOCUMENTS

| | | | |
|---|---|---|---|
| 18,585 | 11/1857 | Hersee | 5/261 |
| 144,906 | 11/1873 | Hoyt | 5/244 |
| 985,380 | 2/1911 | Thompson | 5/261 |
| 1,619,916 | 3/1927 | Brewster | 267/91 |
| 1,808,679 | 6/1931 | Piccolini | 5/239 |
| 2,118,150 | 5/1938 | Brinkley | 267/169 |
| 2,184,396 | 12/1929 | Mudge | 257/146 |
| 2,532,425 | 12/1950 | Schenker | 5/401 |
| 3,031,690 | 5/1962 | Ramsay | 297/284 |
| 4,399,573 | 8/1983 | Baright | 5/239 |

FOREIGN PATENT DOCUMENTS

| | | | |
|---|---|---|---|
| 578627 | 3/1924 | France | 5/261 |

*Primary Examiner*—Gary L. Smith
*Assistant Examiner*—Michael F. Trettel
*Attorney, Agent, or Firm*—A. Thomas Kammer

[57] ABSTRACT

A boxspring is provided with stop members for limiting the amount the springs therein can be compressed. The stop members may be light weight hollow cylindrical members fitted within or about a selected number of springs. Supporting braces having a height sufficient to prevent overstressing of the springs when compressed may also be employed. The braces also have the advantage of providing additional stiffness to the boxspring frame. Areas of the boxspring most vulnerable to damage are protected by selective positioning of the stop members.

10 Claims, 10 Drawing Figures

FIG. 3
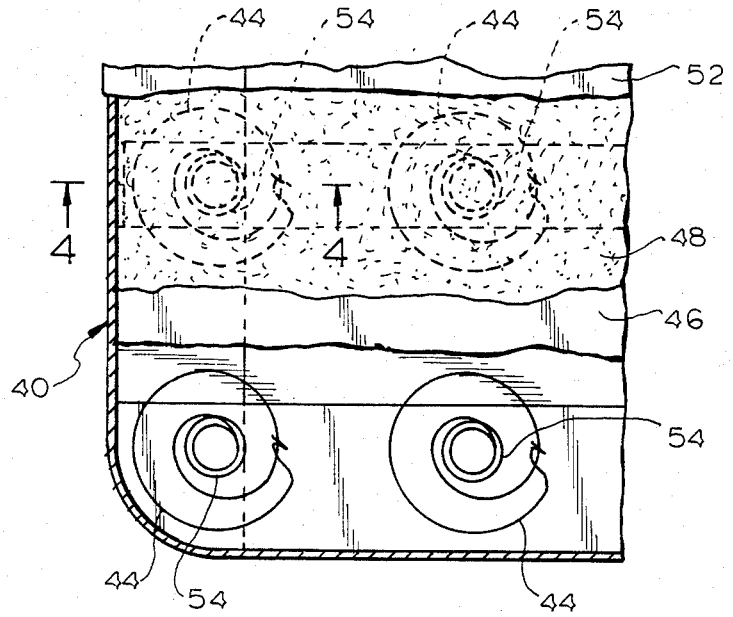
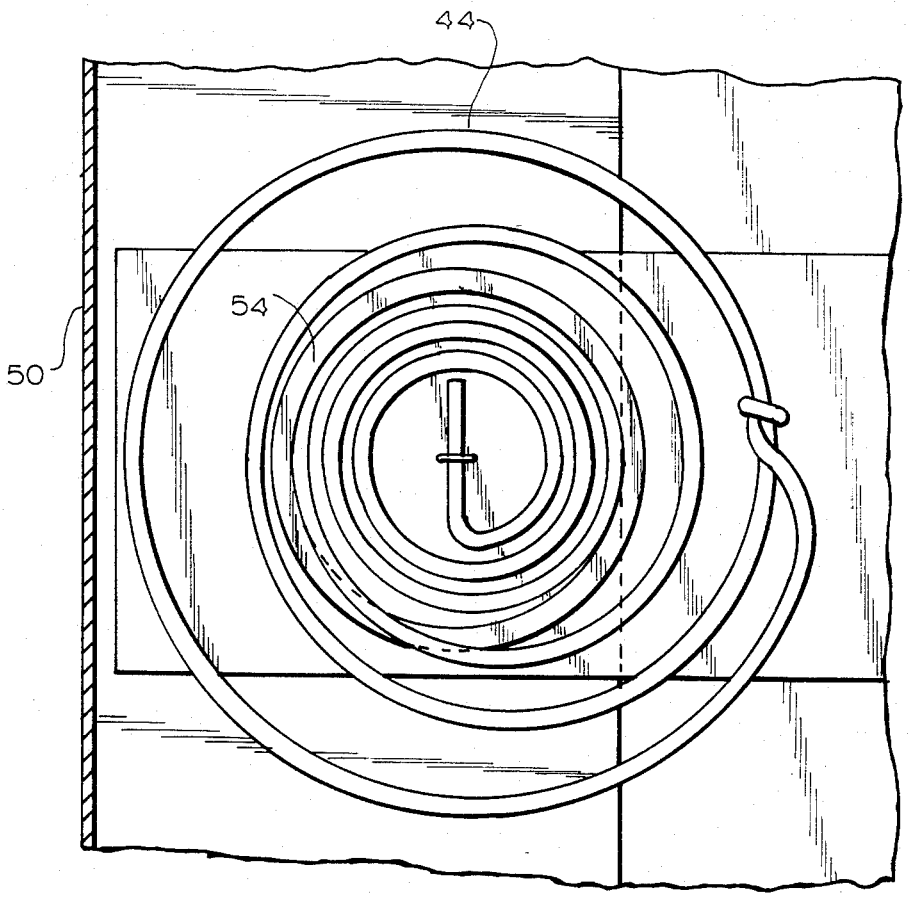
FIG. 6

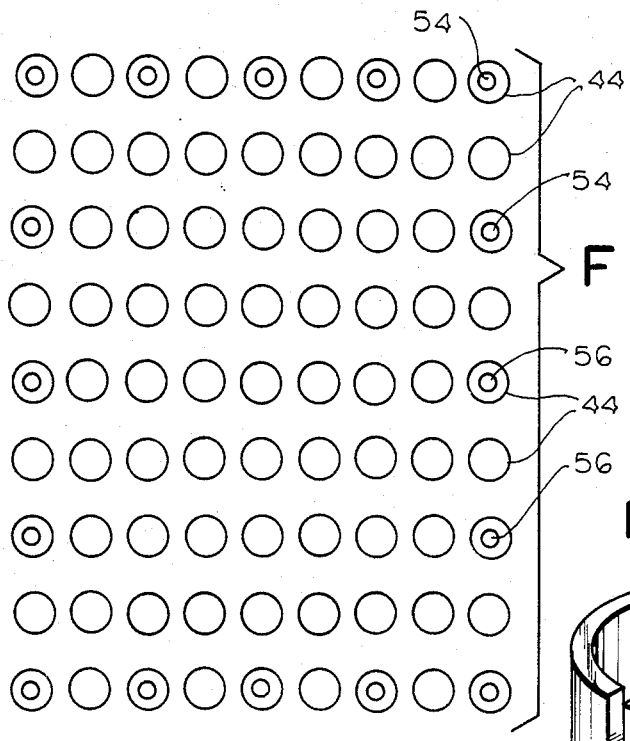
FIG.9
FIG.8
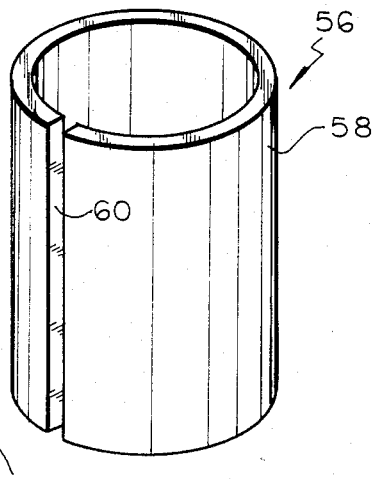
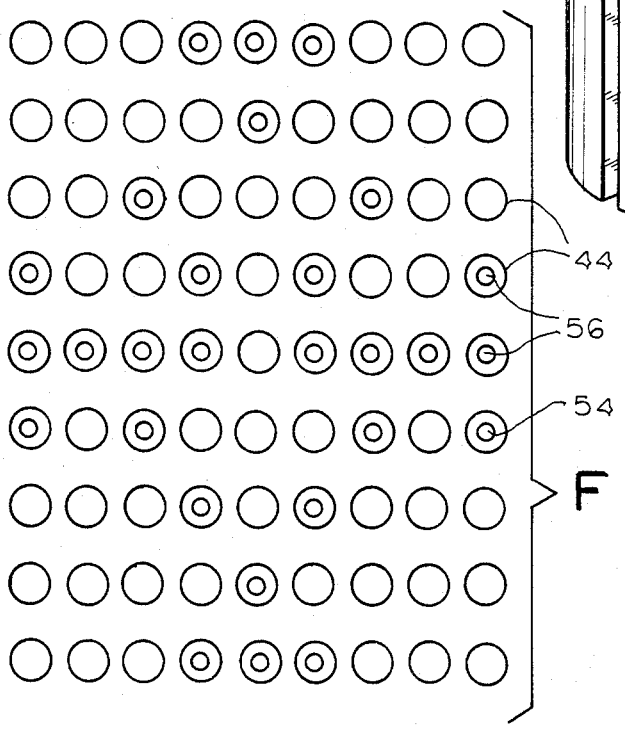
FIG.10

BOXSPRING HAVING COIL COMPRESSION STOPS

BACKGROUND OF THE INVENTION

1. Field of the Invention

The field of the invention relates to a boxspring having means for limiting the compression of at least some of its coil springs to prevent coil setting.

2. Brief Description of the Prior Art

Boxsprings used for supporting mattresses have typically included a plurality of conical, hourglass or uniform diameter coil springs of equal height stapled or otherwise secured to a wood, plastic or steel frame. Such a construction is shown in commonly assigned U.S. Pat. No. 4,399,573 in the name of Leslie I. Baright. The boxspring disclosed in this prior application provides a pair of braces for support of the frame.

It is well known that certain portions of a boxspring are subject to disproportionate loads during use. Whereas a person is usually in a reclining position near the central portions of a bed, thereby distributing the load relatively evenly, the ends and sides of the bed are often used for sitting, thereby providing a greater force over a smaller area. The problems are often particularly acute in hotels and motels where a number of persons may use the bed as a sofa in the absence of adequate seating.

The boxspring supporting the mattress can become damaged when the bed is used too often as a seating structure. If the coil springs are compressed beyond a certain point, they will become "set" and will not recover their original height. This is due to the fact that the springs are designed to have limited deflection ability. Once the boxspring is damaged in this manner, the entire bed may appear tilted and sleeping comfort will be substantially impaired.

The spring designer is faced with a dilemma in attempting to overcome the above problems. A spring construction which allows full compression (convolutions touching) is too soft to meet the needs of the marketplace. A firmer boxspring requires the coil design to allow only partial compression before set (overstress) occurs. Most boxspring coils used today will not recover their original height when compressed more than half of this height.

SUMMARY OF THE INVENTION

A boxspring including means for limiting the deflection of at least some of the springs therein is provided. The springs accordingly will not compress beyond the point at which setting occurs.

A plurality of coil compression stop members may be employed, preferably where the danger of setting is greatest. These members may take the form of substantially cylindrical structures positioned either about or within selected coil springs. Alternatively, they may be longitudinal members mounted directly to the boxspring frame and projecting upwardly towards the grid or upper surface of the boxspring for a selected distance.

BRIEF DESCRIPTION OF THE DRAWINGS

FIG. 3 is a partially cutaway top view of a second embodiment of the invention;

FIG. 6 is a partially sectional view taken along the plane of line 6—6 in FIG. 4;

FIG. 8 is a perspective view of a cylindrical stop member to be employed in conjunction with a coil spring;

FIG. 9 is a schematic view illustrating one possible arrangement of stops in a boxspring construction; and FIG. 10 is a schematic view illustrating another possible arrangement of stops in a boxspring construction.

DETAILED DESCRIPTION OF THE INVENTION

Figure 1:
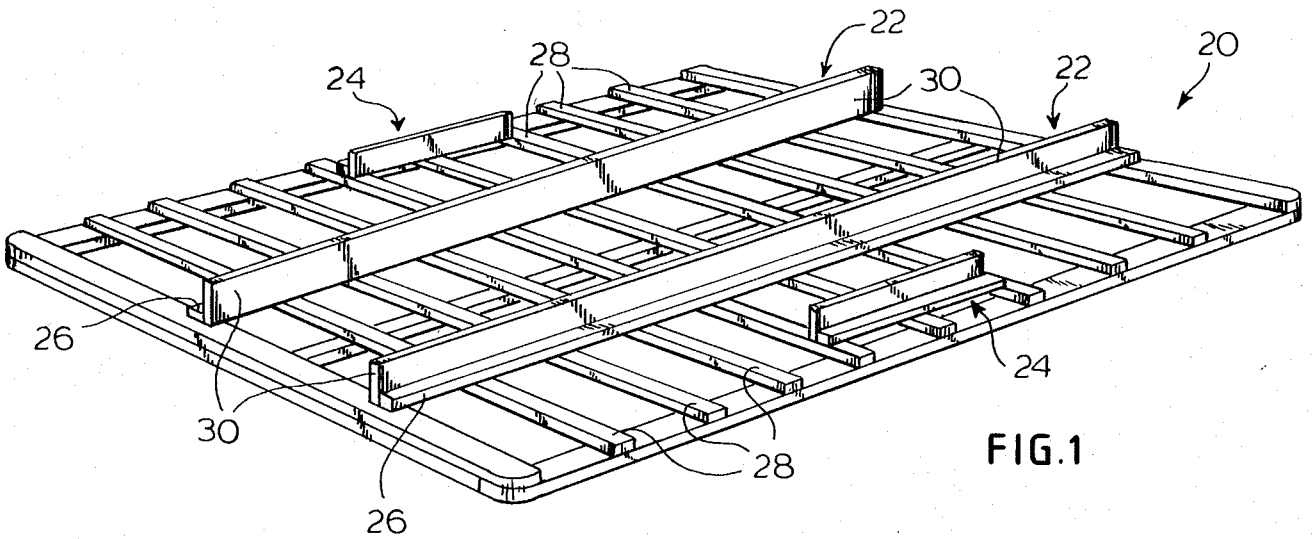
FIG. 1 is a perspective view of a boxspring frame according to a first embodiment of the invention.
Figure 2:
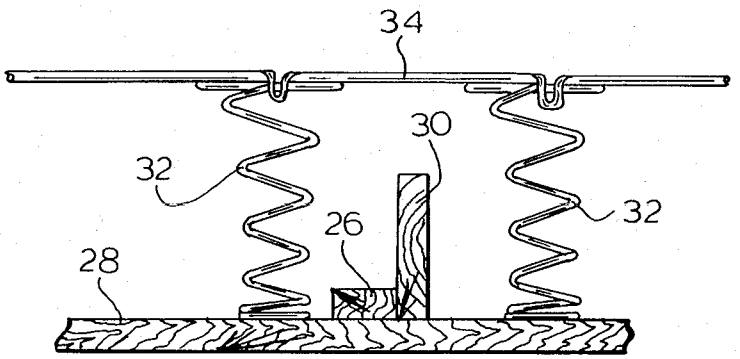
FIG. 2 is a sectional side elevation view of a boxspring frame as shown in FIG. 1 including coil springs and a grid.

A boxspring is provided having means for limiting spring travel, thereby protecting it from loss of working height. One embodiment of the invention is shown in FIGS. 1–2. A typical wood boxspring frame 20 is stiffened by two pairs of L-shaped braces 22,24 fastened thereto. The first pair of braces 22 extend longitudinally for substantially the entire length of the frame. Each includes a first member 26 which lays flat against the lateral slats 28 of the frame and a second member 30 secured perpendicularly with respect thereto. The benefits of such an arrangement are detailed in commonly assigned U.S. Pat. No. 4,399,573. In contrast with said application, the present invention employs wider members 30 standing on end with respect to the slats 28 of the frame 20. Their width (or height) exceeds fifty percent of the normal unstressed height of the conical-shaped coil springs 32. Potential travel of the centrally located coil springs adjacent to the braces 22 accordingly limited to a point before overstressing will occur by limiting the travel of the top assembly coil connecting frame (grid).

Two shorter braces 24 are provided near the central side edges of the frame as shown in FIG. 1. Each are otherwise of the same approximate dimensions as the longer braces 22 and prevent the overstressing of adjacent coil springs. It has been found that the areas of the boxspring protected by the braces 22,24 are the ones that are most likely to be damaged in the absence of such protection. While additional braces could be employed or the shorter ones lengthened, the arrangement as disclosed is satisfactory for most applications and is neither substantially more costly nor heavier than conventional boxspring frames without this protection. A top assembly coil connecting frame 34 is customarily employed for distributing the loads upon the boxspring to a number of the coil springs 32 thereof. It is secured to the upper ends of the coil springs by means of a saddle shaped crimped wire formation, friction fit, interlocking tabs, clips, hog rings or the like.

Figure 4:
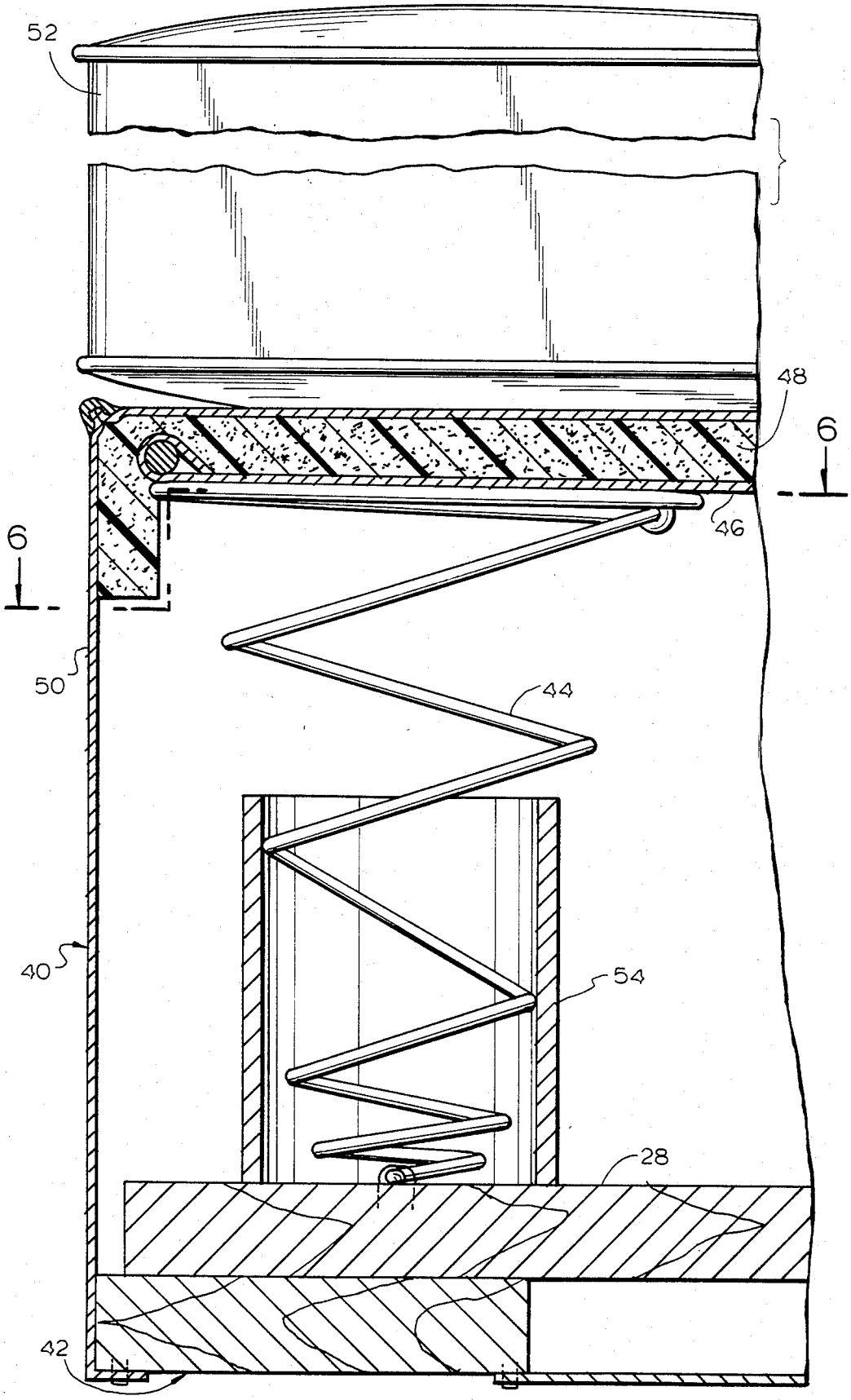
FIG. 4 is a sectional side elevation view thereof taken along the plane of line 4—4 in FIG. 3.
Figure 5:
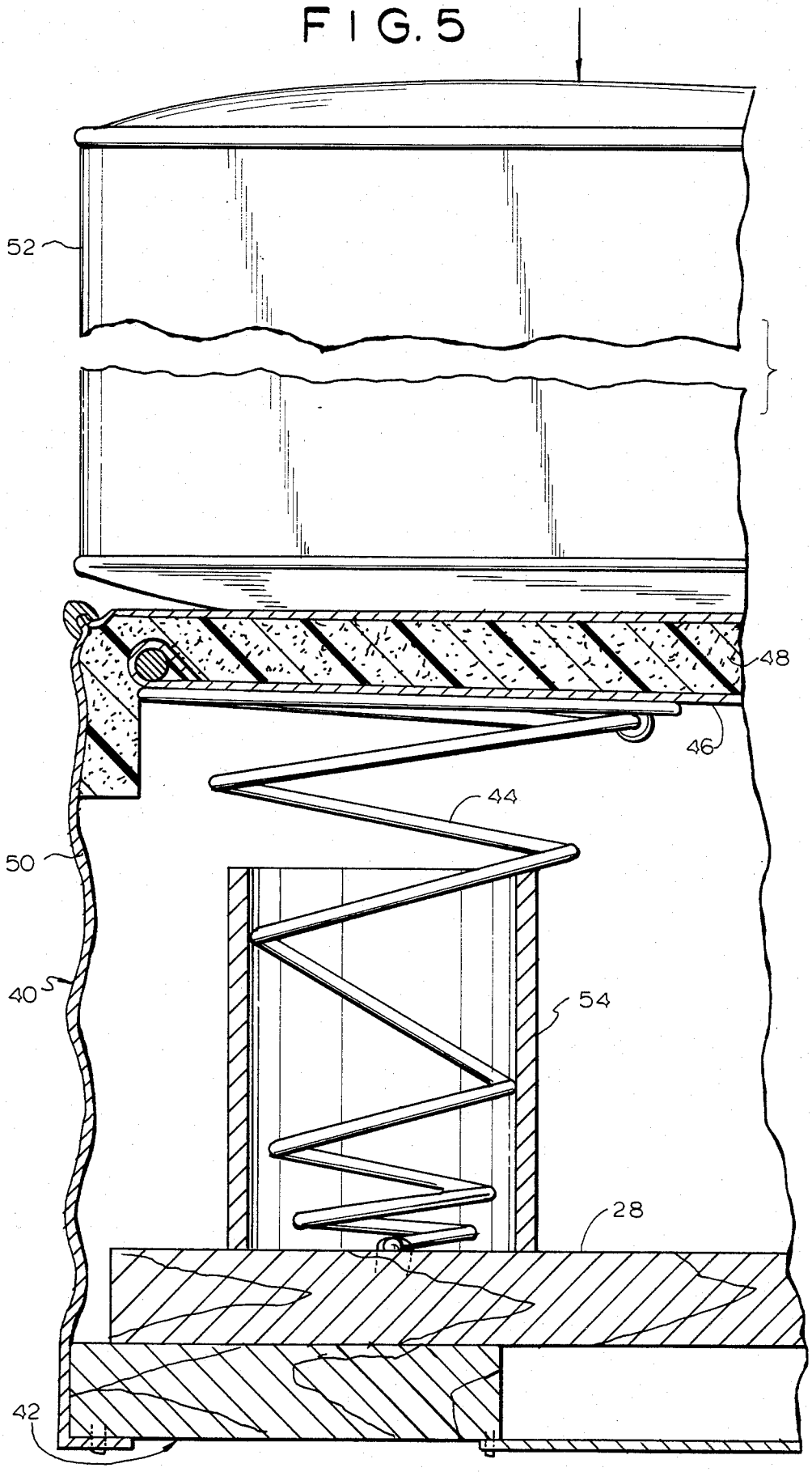
FIG. 5 is similar to FIG. 4 and shows the application of pressure upon the boxspring.

A second embodiment of the invention is shown in FIGS. 3–6. The boxspring 40 shown therein includes a wood frame 42, a plurality of rows of conical-shaped coil springs 44 mounted to the frame, a coil connecting frame 46 mounted to the tops of the springs, cushioning material 48 supported by the wire frame, and a cover 50 or ticking providing the exterior surface for the entire boxspring. A mattress 52 supported by the boxspring 40 is shown in FIGS. 4–5.

To prevent overstressing of at least certain selected coil springs, a plurality of cylindrical stop members 54 are slipped over the lower convolutions thereof prior to stapling the springs to the frame 42. The stop members need not be fastened to the springs or the frame in any manner in order to perform their intended function. They are preferably constructed from a sturdy, light weight, and inexpensive material such as corrugated paper or plastic. These materials will also prevent squeaking should the convolutions contact them at any point. The stop members 54 may frictionally engage the lower convolutions of the springs.

Figure 7:
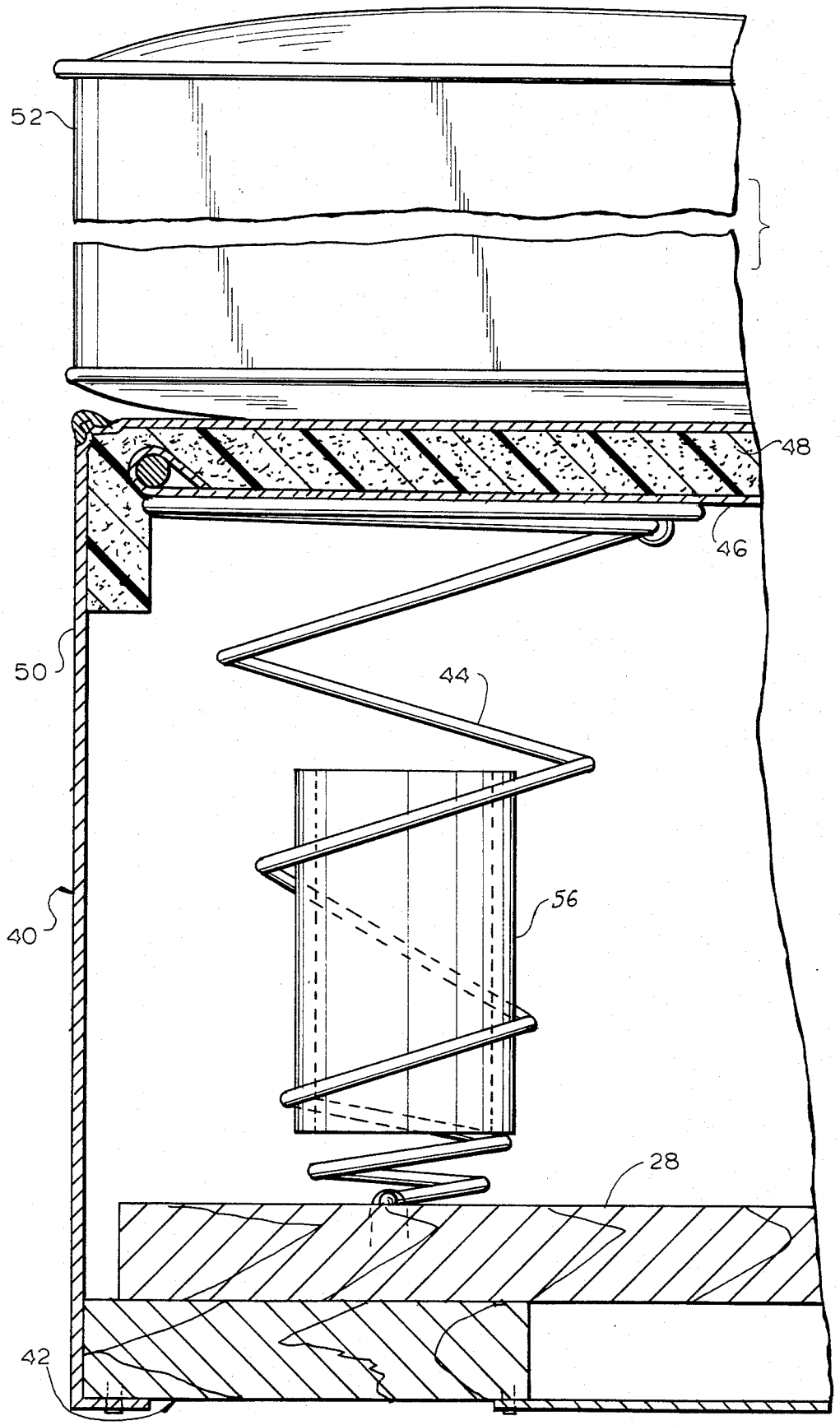
FIG. 7 is a sectional side elevation view of a third embodiment of the invention.

A slightly different embodiment of the invention is shown in FIG. 7. All numerals used in FIGS. 3–6 are used to designate similar parts in FIG. 7 with the exception of the cylindrical stop member 56. The stop member 56 is positioned within the coil spring 44 and in resilient engagement with the lower convolutions thereof. It includes a cylindrical body 58 having a longitudinal slot 60 therein. The slot allows the body to flex when the stop member is inserted within the coil spring. FIG. 8 illustrates this member most clearly.

FIGS. 9–10 show two possible arrangements of stop members in a boxspring. The stop members may be of either of the above-discussed constructions. FIG. 9 shows an arrangement wherein alternating perimeter coil springs 44 are provided with stop members 54 or 56. The construction illustrated in FIG. 10 provides protection where the boxspring is most vulnerable to damage. Each stop member prevents the coil spring associated therewith from compressing to less than half its original height. A total of twenty-eight stop members are employed in this FIGURE.

It will be appreciated that the concepts of the present invention may be applied in conjunction with springs of entirely different coil shape than shown herein where overstressing is a potential problem. In addition, stop members of various constructions may be used within the same boxspring to provide the desired results.

What is claimed is:

1. A boxspring comprising:

a frame;

a support surface for supporting a mattress;

spring means including a plurality of coil springs mounted to said frame and resiliently supporting said support surface; and stop means including a plurality of hollow cylindrical stop members positioned respectively about a plurality of said coil springs and between said frame and said support surface for limiting the potential compression of said spring means, said stop means having a height sufficient to prevent overstressing of said spring means when a load is applied to said support surface.

2. A boxspring as defined in claim 1 wherein said stop members frictionally engage said coil springs.

3. A boxspring as defined in claim 1 wherein said stop members are not fastened to said frame.

4. A boxspring as defined in claim 1 wherein said frame includes a plurality of parallel rows of coil springs mounted thereto, said stop members being positioned about some of said coil springs and not others.

5. A boxspring as defined in claim 4 wherein a greater concentration of stop members are positioned near the head and foot portions and near the side edge portions of said frame than near the corners thereof.

6. A boxspring as defined in claim 1 wherein said frame includes a plurality of parallel rows of coil springs mounted thereto, said stop members being positioned about some of said coils and not others.

7. A boxspring as defined in claim 6 wherein a greater concentration of stop members are positioned near the head and foot portions and near the side edge portions of said frame than near the corners thereof.

8. A boxspring comprising:

a substantially rectangular frame including a plurality of laterally extending slats;

a plurality of rows of coil springs of substantially equal height fastened to said frame and extending upwardly therefrom; and first and second pairs of parallel braces fastened to said frame and extending longitudinally with respect thereto, said braces having a height which is at least half the height of the coil springs in their uncompressed state, said first pair of braces being centrally positioned with respect to said frame, said second pair of braces being positioned, respectively, near the respective longitudinal edges of said frame and substantially midway between the ends thereof, said second pair of braces being substantially shorter than said first pair of braces.

9. A boxspring comprising:

a frame;

a support surface for supporting a mattress;

a plurality of conically shaped coil springs mounted to said frame and resiliently supporting said support surface; and stop means positioned between said frame and said support surface for limiting the potential compression of said coil springs, said stop means including a plurality of hollow cylindrical stop members, each of which is positioned within the smaller convolutions of said coil springs and in resilient engagement therewith, said stop members not being fastened to said frame.

10. A boxspring as defined in claim 9 wherein at least one of said stop members is hollow and includes a longitudinal slot extending the length thereof.

* * * * *